US007959413B2

(12) United States Patent
Ho et al.

(10) Patent No.: US 7,959,413 B2
(45) Date of Patent: Jun. 14, 2011

(54) FAN AND IMPELLER THEREOF

(75) Inventors: Shihhua Ho, Taoyuan Hsien (TW); Shihying Huang, Taoyuan Hsien (TW); Tsung Yu Lei, Taoyuan Hsien (TW); Chung-kai Lan, Taoyuan Hsien (TW); Huan-Chi Chen, Taoyuan Hsien (TW); Wen-Shi Huang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 961 days.

(21) Appl. No.: 11/655,198

(22) Filed: Jan. 19, 2007

(65) Prior Publication Data

US 2007/0172350 A1 Jul. 26, 2007

(30) Foreign Application Priority Data

Jan. 23, 2006 (TW) ..... 95102483 A

(51) Int. Cl.
*F04D 29/38* (2006.01)

(52) U.S. Cl. ..... 416/234

(58) Field of Classification Search ..... 416/189, 416/193 R, 196 R, 234, 248; 415/119
See application file for complete search history.

(56) References Cited

U.S. PATENT DOCUMENTS

| | | | | |
|---|---|---|---|---|
| 2,801,793 | A * | 8/1957 | Kline | 416/93 R |
| 6,565,320 | B1 * | 5/2003 | Surls et al. | 416/175 |
| 7,419,359 | B2 * | 9/2008 | Spaggiari | 416/183 |
| 7,438,522 | B2 * | 10/2008 | Eimer | 415/173.6 |
| 2003/0138324 | A1 * | 7/2003 | Hsieh | 416/183 |

FOREIGN PATENT DOCUMENTS

GB 2 041 103 A * 9/1980

* cited by examiner

*Primary Examiner* — Nathaniel Wiehe
(74) *Attorney, Agent, or Firm* — Birch, Stewart, Kolasch & Birch, LLP

(57) ABSTRACT

A fan includes an impeller and a motor. The impeller includes a hub and a plurality of blades. The hub has a top portion, a connection portion, and at least one airflow-guiding portion. The top portion is connected to the connection portion. The blades are disposed around the connection portion. The motor is disposed corresponding to the impeller and used to drive the impeller to rotate. The airflow-guiding portion is disposed between two adjacent blades.

20 Claims, 7 Drawing Sheets

2

FAN AND IMPELLER THEREOF

BACKGROUND OF THE INVENTION

1. Field of Invention

The invention relates to a fan and an impeller thereof, and, in particular, to a fan and an impeller thereof that can reduce noise and increase airflow quantity.

2. Related Art

Since the present electronic products are rapidly developed towards high performance, high frequency, high speed and more compact, the generated heat of the electronic products becomes greater. Utilizing a fan to dissipate the heat generated by the electronic products is a common solution. In this case, the airflow pressure and the airflow quantity of the fan are important reference factors for determining the performance of the fan. Besides, the noise of the fan is also an important reference factor for the fan.

As shown in FIG. 1, a conventional fan 1 includes an impeller 11 and a motor (not shown). The impeller 11 includes a hub 111 and a plurality of blades 112, which are connected to and disposed around the periphery of the hub 111. The periphery of the hub 111 has a ring-shaped guiding angle 1111. Herein, the guiding angle 1111 is a round angle for guiding the airflow around the hub 111 into the blades 112, so that the air intake efficiency of the fan 1 can be increased.

However, when the curvature of the guiding angle 1111 is increased, the air-inlet end of the blades 112 may form an air resistant area with a large turn, which decreases the performance of the fan 1. If the curvature of the guiding angle 1111 is decreased, the air located at the periphery of the hub 111 may not be guided into the blades 112. In addition, the air-inlet area of the blades 112 is composed of the top portions of two adjacent blades. Thus, no matter how many degrees the guiding angle 1111 is, the air-inlet area of the blades 112 remains the same, resulting in that the air intake efficiency of the fan 1 can not be increased.

As shown in FIG. 2, no matter how many degrees the ring-shaped guiding angle 1111 is, the airflow will generate the vortexes 1121 and the airflow separation phenomenon behind the blades 112 after passing through the blades 112. This will affect the performance of the fan 1 and generate the noise.

Therefore, it is an important subject of the invention to provide a fan and an impeller thereof, which can increase the actual air intake, decrease the noise when the impeller rotates, and improve the performance of the fan.

SUMMARY OF THE INVENTION

In view of the foregoing, the invention is to provide a fan and an impeller thereof capable of increasing the actual air intake of the fan, decreasing the noise of the fan when the impeller rotates, and improving the performance of the fan.

To achieve the above, an impeller of the invention includes a hub and a plurality of blades. In the invention the hub has a top portion, a connection portion and at least one airflow-guiding portion. The top portion is connected to the connection portion. The blades are disposed around the connection portion. The airflow-guiding portion is disposed between two adjacent blades.

To achieve the above, the invention discloses a fan including an impeller and a motor. In the invention, the impeller includes a hub and a plurality of blades. The hub has a top portion, a connection portion and at least one airflow-guiding portion. The top portion is connected to the connection portion. The blades are disposed around the connection portion, and the airflow-guiding portion is disposed between two adjacent blades. The motor is disposed corresponding to the impeller for driving the impeller to rotate.

To achieve the above, the invention also discloses an impeller, including a hub and a plurality of blades. The hub has a top portion, a connection portion and at least one airflow-guiding portion. The top portion is connected to the connection portion. The blades are disposed around the connection portion, and the airflow-guiding portion is located on the hub and at a position higher than a windward surface of the blades.

To achieve the above, the invention further discloses an impeller, comprising a hub and a plurality of blades. The hub has a top portion, a connection portion and at least one airflow-guiding portion. The top portion is connected to the connection portion. The blades are disposed around the connection portion, and the airflow-guiding portion is located on or higher than an extending line extended from an end of the blade connecting with the hub.

To achieve the above, the invention also discloses a fan, including an impeller and a motor. The impeller includes a hub and a plurality of blades. The hub has a top portion, a connection portion and at least one airflow-guiding portion, and the top portion is connected to the connection portion. The blades are disposed around the connection portion. The airflow-guiding portion is located on the hub and at a position higher than a windward surface of the blades. The motor is disposed corresponding to the impeller for driving it to rotate.

To achieve the above, the invention further discloses a fan, including an impeller and a motor. The impeller includes a hub and a plurality of blades. The hub has a top portion, a connection portion and at least one airflow-guiding portion, and the top portion is connected to the connection portion. The blades are disposed around the connection portion. The airflow-guiding portion is located on or higher than an extending line extended from an end of the blade connecting with the hub. The motor is disposed corresponding to the impeller for driving it to rotate.

As mentioned above, the fan and impeller of the invention have at least one airflow-guiding portion for increasing the air-inlet area or changing the airflow field of the air entering the blades. Thus, the air resistance can be reduced and the air-intake efficiency can be increased. Accordingly, the vortexes and airflow separation phenomenon may be avoided, the noise is decreased, and the performance of the fan can be enhanced.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
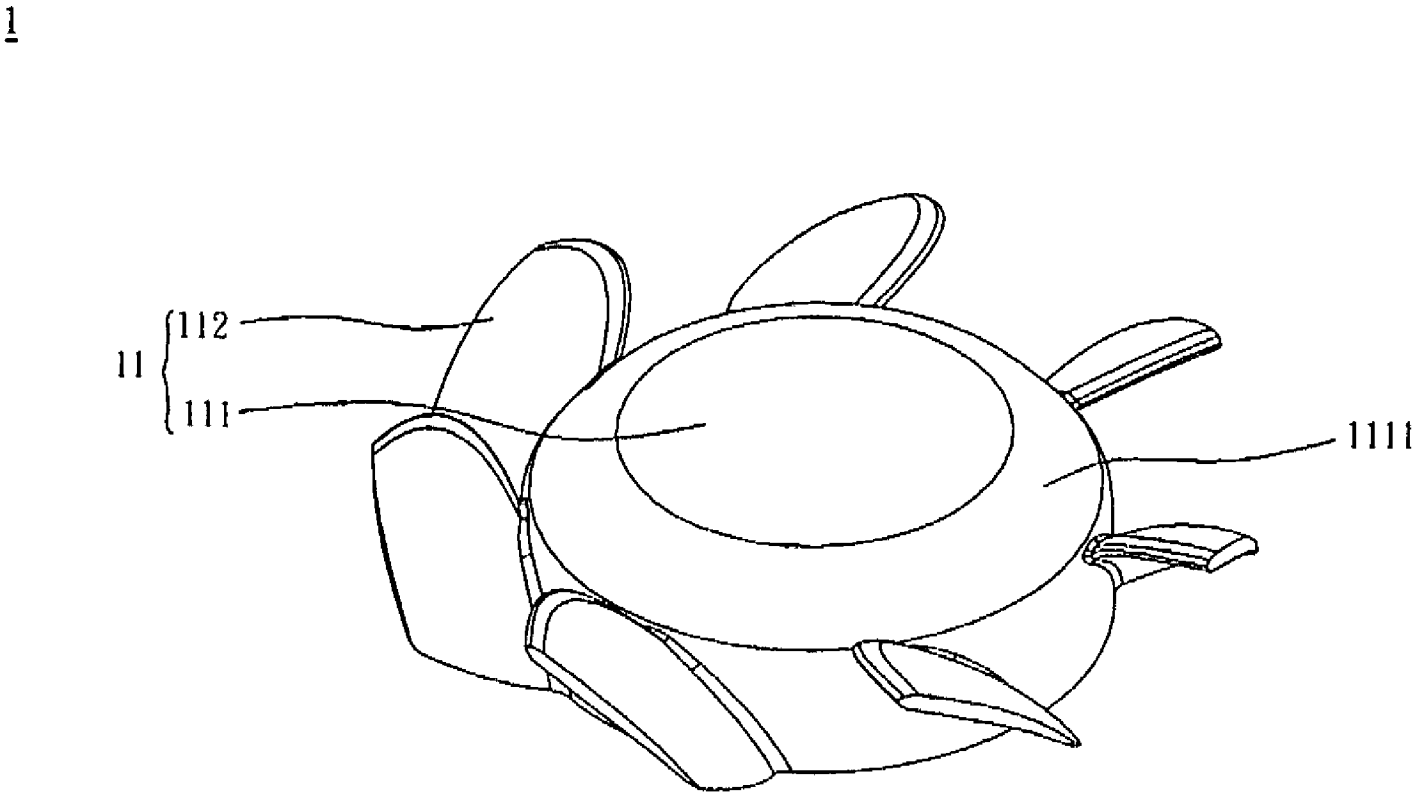
PRIOR ART FIG. 1
FIG. 1 is a schematic diagram of the conventional fan.
Figure 2:
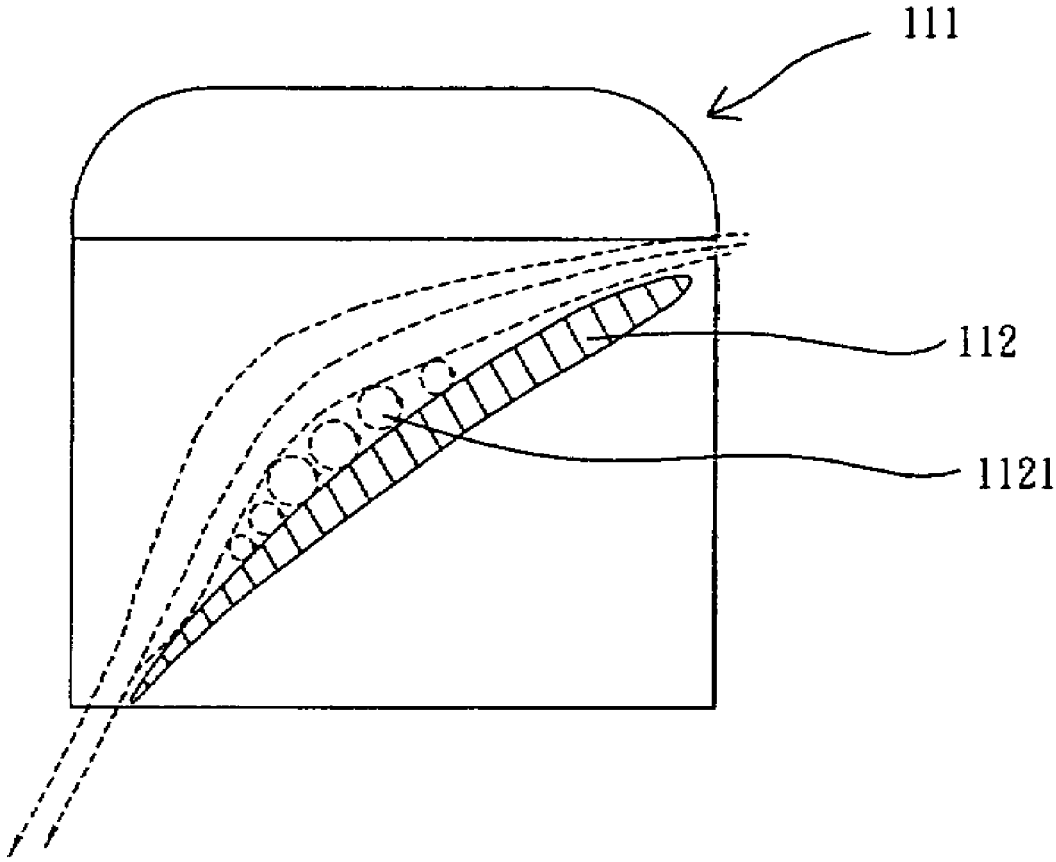
PRIOR ART FIG. 2
FIG. 2 is a schematic diagram showing the airflow passing through the conventional hub and blade.
Figure 3:
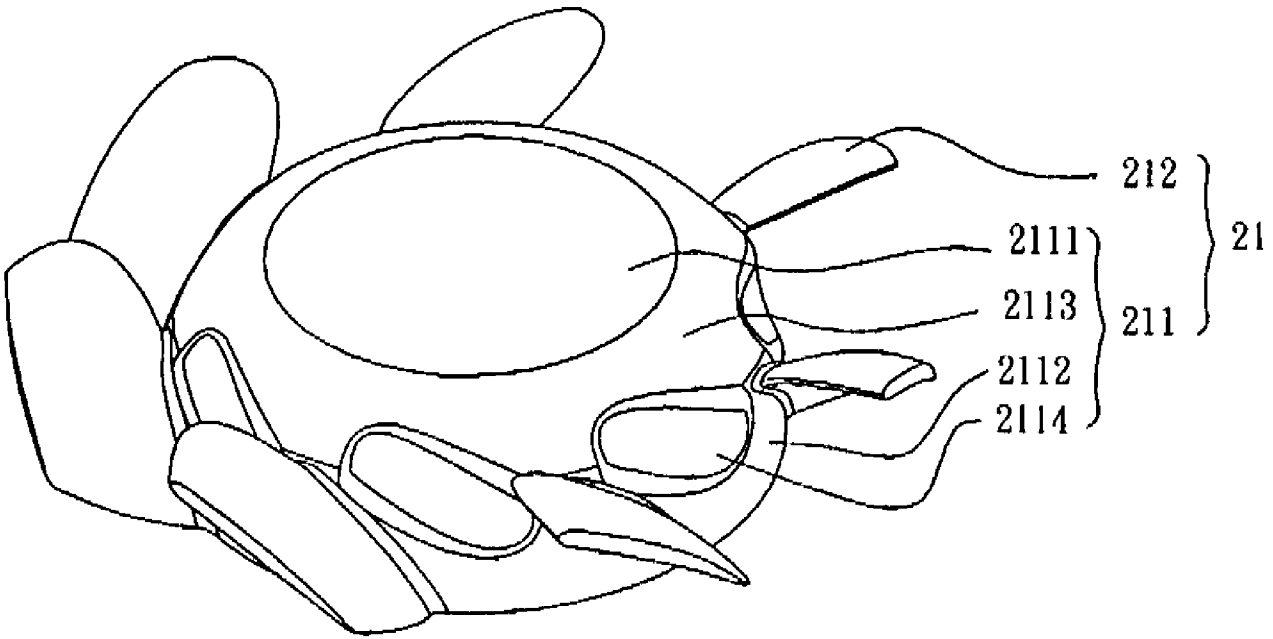
FIG. 3 is a schematic diagram of a fan according to a preferred embodiment of the invention.

With reference to FIG. 3, a fan 2 according to a preferred embodiment of the invention includes an impeller 21 and a motor (not shown). The fan 2 may be an exterior-rotor axial-flow fan or an interior-rotor axial-flow fan. The motor connects to the impeller for driving the impeller to rotate. The motor may be set in the impeller 21 or out of the impeller 21.

Figure 6:
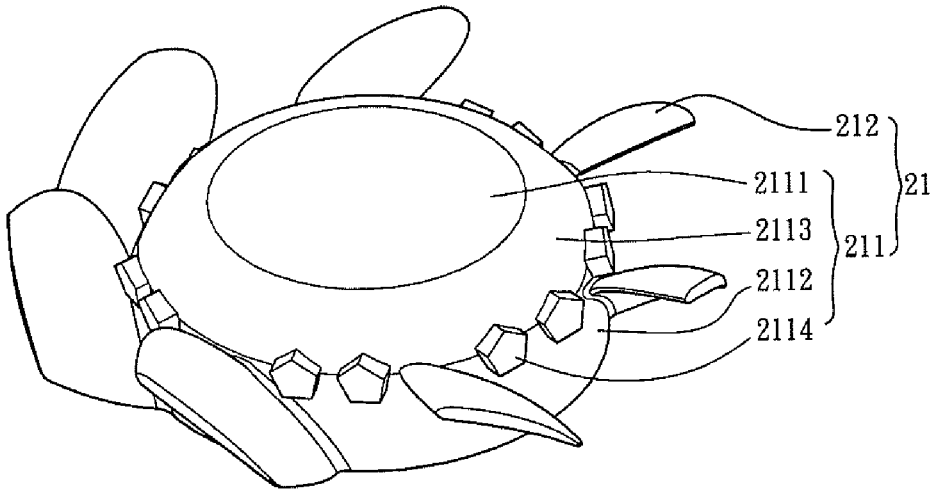
FIGS. 6 and 7 are schematic diagrams of another two fans according to the preferred embodiment of the invention.
Figure 7:
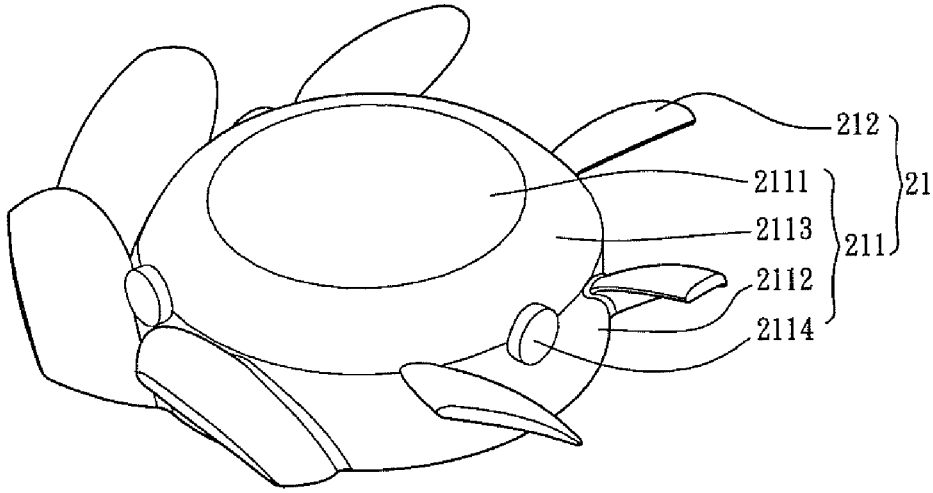

The impeller 21 includes a hub 211 and a plurality of blades 212. The hub 211 has a top portion 2111, a connection portion 2112, and at least one airflow-guiding portion 2114. In this embodiment, the airflow-guiding portion 2114 is disposed between two adjacent blades 212 and is extended to the top portion 2111. In addition, the first airflow-guiding portion 2114 can be contacted with adjacent two of the blades 212. The airflow-guiding portion 2114 is preferably located between the air-inlet ends of two adjacent blades 212. The direction of the airflow-guiding portion 2114 depends on the direction of an airflow field provided by the blades 212 or the fan 2. In addition, the airflow-guiding portion 2114 may extend to the connection portion 2112 and/or the surface of the blade 212 depending on the actual demands. The airflow-guiding portion 2114 may be a recess (as shown in FIG. 3) or a protrusion (as shown in FIGS. 6 and 7). For example, the airflow-guiding portion 2114 may be a lump-shaped or rib-shaped protrusion. The airflow-guiding portion 2114 may have a polygon (as shown in FIG. 6), a circle (as shown in FIG. 7), an ellipse (as shown in FIG. 3) or other specific shape.

As shown in FIGS. 3, 4, 6 and 7, the number of the airflow-guiding portions 2114 may be equal to or unequal to the number of the blades 212. For example, the impeller 211 may have nothing or have one or more airflow-guiding portions 2114 between two adjacent blades 212. The airflow-guiding portion 2114 is integrally formed on the hub 211 as a single piece. In more specific, the connection portion 2112, the top portion 2111, and the airflow-guiding portion 2114 are integrally formed as a single piece.

Figure 8:
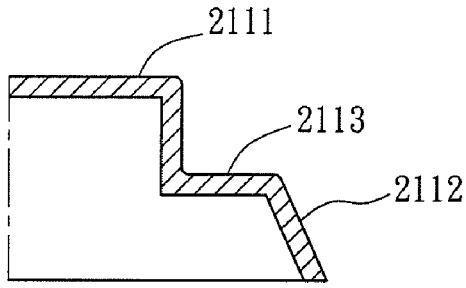
FIGS. 8-10 are sectional diagrams showing three type of a guiding angle of the fan according to the preferred embodiment of the invention.
Figure 9:
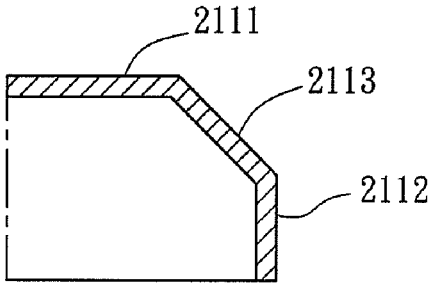
Figure 10:
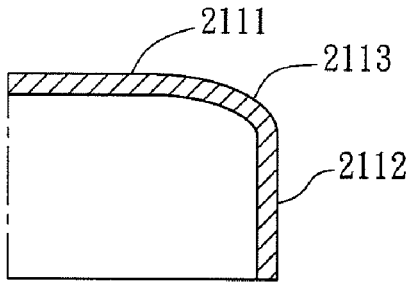

The hub 211 further includes a guiding angle 2113, which is located between the top portion 2111 and the connection portion 2112. The guiding angle 2113 is connected with the top portion 2111 and the connection portion 2112. The guiding angle 2113 may be a right angle (as shown in FIG. 8), an oblique angle (as shown in FIG. 9), a round angle (as shown in FIG. 3) or an elliptic angle (as shown in FIG. 10). In more specific, the guiding angle 2113 is a ring-shaped structure. The guiding angle 2113 is integrally formed on the hub 211 as a single piece. In more details, the guiding angle 2113, the connection portion 2112, the top portion 2111, and the airflow-guiding portion 2114 are integrally formed as a single piece. Furthermore, the airflow-guiding portion 2114 may extend to the guiding angle 2113.

The blades 212 are disposed around and connected to the connection portion 2112. The top ends of the blades 212 are extended to a top end of the connection portion 2112, the guiding angle 2113 or the edge of the top portion 2111. The blades 212 and the hub 211 may be integrally formed as a single piece or individually prepared. The blades 212 may be the curved blades, the plate-shaped blades, the polygonal blades, the arc-shaped blades or other axial-flow blades.

In the present embodiment, the airflow-guiding portion 2114 is located between two adjacent blades 212, and the airflow-guiding portion 2114 extends from the top portion 2111 to the location between the two adjacent blades 212. Thus, the air-inlet area between the two blades 212 can be efficiently increased, so that the air intake and the heat dissipation effect of the fan 2 can be greatly improved.

Figure 4:
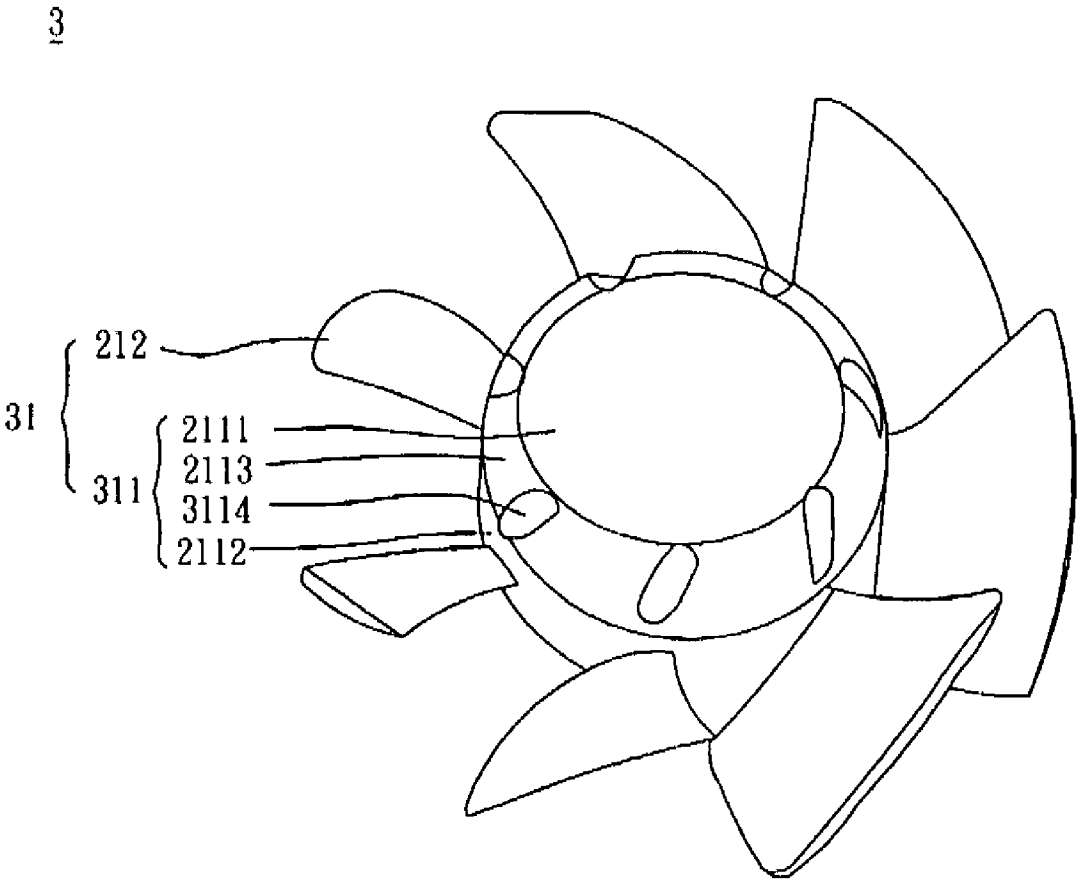
FIG. 4 is a schematic diagram of a fan according to another preferred embodiment of the invention.
Figure 5:
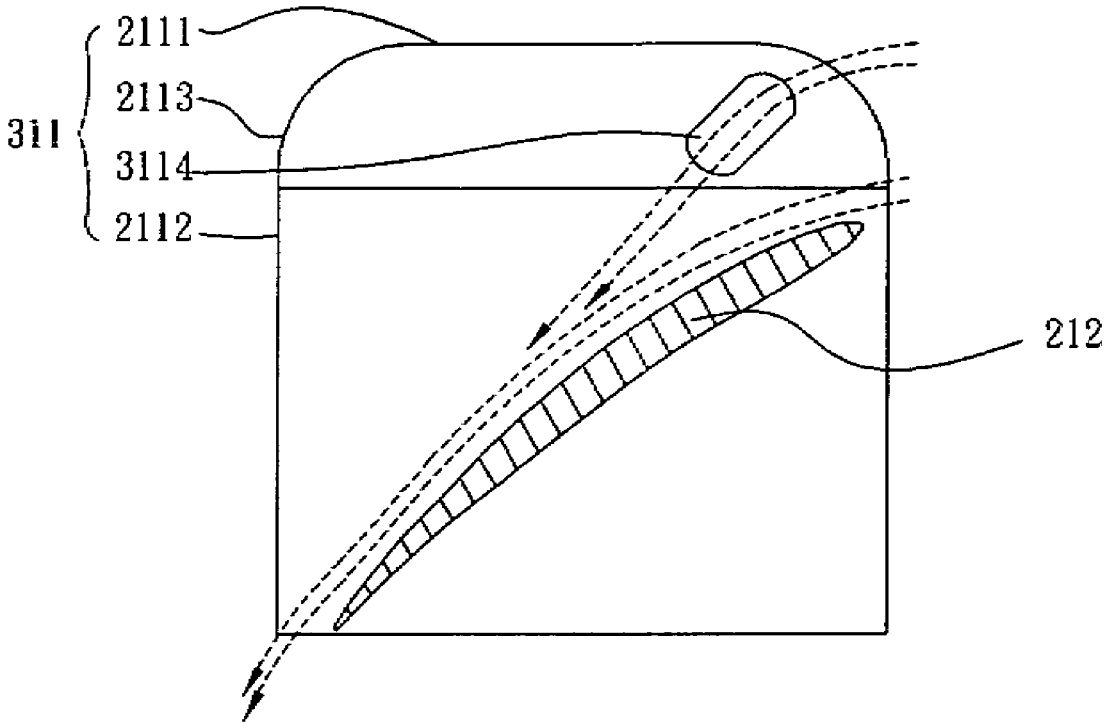
FIG. 5 is a schematic diagram showing an airflow passing through the hub and blade of FIG. 4.

FIG. 4 is a schematic diagram of a fan 3 according to another embodiment of the invention. FIG. 5 is a schematic diagram showing an airflow passing through the hub and blade of the fan 3. With reference to FIG. 4 and FIG. 5, the airflow-guiding portion 3114 of the impeller 31 of the fan 3 is located on the hub 211 and at a position higher than a windward surface of the blades 212, which is different from the previously mentioned fan 2. In the embodiment, the airflow-guiding portion 3114 is preferably located on or higher than an extending line extended from an end of the blade 212 connecting with the hub 311. The airflow-guiding portion 3114 may contact with a wing surface or a front edge of the blade 212. Since the airflow-guiding portion 3114 is higher than the top of the blade 212, it can efficiently make the airflow passing through the blades 212 steadier. Thus, the vortex and airflow separation phenomenon can be avoided, and the noise caused by the rotating fan 3 can than be reduced. The airflow-guiding portion 3114 may also increase the air-inlet area of the blades 212, so that the air-intake of the fan 3 can be improved.

In this embodiment, if the airflow-guiding portions 3114 are recesses, the noise may be reduced to 84% to 90%. If the airflow-guiding portions 3114 are protrusions, the noise may be reduced to 90% to 93%.

In addition, the invention may provide additional airflow-guiding portions at the two positions mentioned above. Of course, the air-intake may be increased and the noise may be reduced.

In summary, the fan and impeller of the invention have at least one airflow-guiding portion for increasing the air-inlet area or changing the airflow field of the air passing through the blades. Thus, the air resistance of the fan can be reduced and the air-intake efficiency of the fan can be increased. Accordingly, the vortexes and airflow separation phenomenon of the fan may be avoided, the noise is decreased, and the performance of the fan can be enhanced.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A fan comprising:

an impeller, comprising:

a hub having a top portion, a connection portion, at least one guiding angle and at least one first airflow-guiding portion, wherein the top portion is connected to the connection portion, the guiding angle is located between the top portion and the connection portion, the first airflow-guiding portion is located between the guiding angle and the connection portion, and a plurality of blades disposed around the connection portion, wherein the first airflow-guiding portion is disposed between adjacent two of the blades, disposed higher than a windward surface of the blades, located on an extending line extended from an end of the blade connecting with the hub or disposed higher than the extending line; and a motor disposed corresponding to the impeller for driving the impeller to rotate.

2. The fan of claim 1, wherein the first airflow-guiding portion is a recess or a protrusion.

3. The fan of claim 1, wherein the first airflow-guiding portion is contacted with adjacent two of the blades.

4. The fan of claim 1, wherein the first airflow-guiding portion has a shape of a polygon, a circle, or an ellipse.

5. The fan of claim 1, wherein the first airflow-guiding portion is extended to the top portion, the connection portion or surfaces of the blades.

6. The fan of claim 1, wherein the number of the first airflow-guiding portion is less than, equal to, or greater than the number of the blades.

7. The fan of claim 1, wherein the top portion, the connection portion and the first airflow-guiding portion are integrally formed as a single piece.

8. The fan of claim 1, wherein the guiding angle is a right angle, an oblique angle, a round angle, an elliptic angle, or a ring-shaped structure.

9. The fan of claim 8, wherein the first airflow-guiding portion is extended to the guiding angle.

10. The fan of claim 8, wherein top ends of the blades are extended to a top end of the connection portion, the guiding angle or an edge of the top portion.

11. The fan of claim 1, further comprising:

a second airflow-guiding portion disposed higher than a windward surface of the blades, or located on or higher than the extending line.

12. The fan of claim 11, wherein the second airflow-guiding portion is a recess or a protrusion.

13. The fan of claim 11, wherein the second airflow-guiding portion has a shape of a polygon, a circle, or an ellipse.

14. The fan of claim 11, wherein the second airflow-guiding portion is extended to pass through or contact with a wing surface or a front edge of the blade.

15. The fan of claim 11, wherein the second airflow-guiding portion is extended to the top portion, the connection portion, or surfaces of the blades.

16. An impeller comprising:

a hub having a top portion, a connection portion, at least one guiding angle and at least one airflow-guiding portion, wherein the top portion is connected to the connection portion, the guiding angle is located between the top portion and the connection portion, the airflow-guiding portion is located between the guiding angle and the connection portion; and a plurality of blades disposed around the connection portion, wherein the airflow-guiding portion is disposed between adjacent two of the blades, disposed higher than a windward surface of the blades, located on an extending line extended from an end of the blade connecting with the hub or disposed higher than the extending line.

17. The impeller of claim 16, wherein the airflow-guiding portion is contacted with adjacent two of the blades.

18. The impeller of claim 16, wherein the airflow-guiding portion is extended to pass through or contact with a wing surface or a front edge of the blade.

19. The impeller of claim 16, wherein the airflow-guiding portion is extended to the top portion, the connection portion or surfaces of the blades.

20. A fan comprising:

an impeller, comprising:

a hub having a top portion, a connection portion, at least one guiding angle and at least one first airflow-guiding portion, wherein the top portion is connected to the connection portion, and the guiding angle is located between the top portion and the connection portion, and a plurality of blades disposed around the connection portion, wherein the first airflow-guiding portion is disposed between adjacent two of the blades, disposed higher than a windward surface of the blades, located on an extending line extended from an end of the blade connecting with the hub or disposed higher than the extending line, wherein the top of the first airflow-guiding portion is higher than the top of the blades, and the direction of the first airflow-guiding portion depends on the direction of an airflow field provided by the blades; and a motor disposed corresponding to the impeller for driving the impeller to rotate.

* * * * *